US007714805B2

(12) United States Patent
Han et al.

(10) Patent No.: US 7,714,805 B2
(45) Date of Patent: May 11, 2010

(54) METHOD OF DRIVING PLASMA DISPLAY PANEL

(75) Inventors: Jung Gwan Han, Gumi-si (KR); Soo Seok Sim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 788 days.

(21) Appl. No.: 11/024,018

(22) Filed: Dec. 29, 2004

(65) Prior Publication Data

US 2005/0162346 A1 Jul. 28, 2005

(30) Foreign Application Priority Data

Dec. 31, 2003 (KR) ..... 10-2003-0102174

(51) Int. Cl.
*G09G 3/28* (2006.01)

(52) U.S. Cl. ..... 345/60; 313/582

(58) Field of Classification Search ..... 315/169.4; 345/60; 313/582–587
See application file for complete search history.

(56) References Cited

U.S. PATENT DOCUMENTS 6,150,766 A * 11/2000 Shino et al. ..... 315/169.4
6,160,529 A * 12/2000 Asao et al. ..... 345/60
6,369,781 B2 * 4/2002 Hashimoto et al. ..... 345/60
7,187,347 B2 * 3/2007 Tanaka et al. ..... 345/60
2001/0005190 A1 * 6/2001 Furutani ..... 345/60
2002/0180667 A1 12/2002 Kim
2005/0093779 A1 * 5/2005 Kim et al. ..... 345/60

FOREIGN PATENT DOCUMENTS

EP 0 866 439 A1 9/1998

* cited by examiner

*Primary Examiner*—Amare Mengistu
*Assistant Examiner*—Yuk Chow
(74) *Attorney, Agent, or Firm*—McKenna Long & Aldridge LLP

(57) ABSTRACT

Disclosed therein a method of driving a plasma display panel, which can improve display quality. The method is separately driven by a data driving period for supplying a driving waveform and a preliminary period for raising voltages for supplying the driving waveform up to a desired voltage, in order to display an image in each discharge cell, wherein a waveform supplied to electrodes during a sustain period of the data driving period is different from a waveform supplied to the electrodes during a sustain period of the preliminary period. The method does not create a sustain discharge during a sustain period and prevents an afterimage caused by a previous state when the PDP is turned on from being displayed, improving display quality. Moreover, charges within a discharge cell are eliminated by supplying a ground voltage to electrodes for 1 to 3 seconds, preferably 2 seconds, before a data driving waveform is supplied. Therefore, an afterimage is prevented from being displayed on the entire screen, and display quality can be improved.

14 Claims, 6 Drawing Sheets

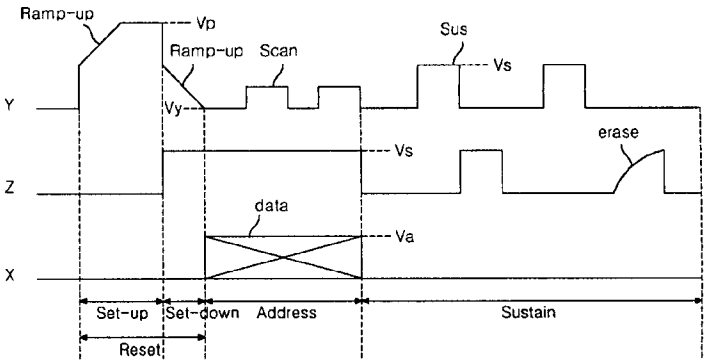
Fig. 5
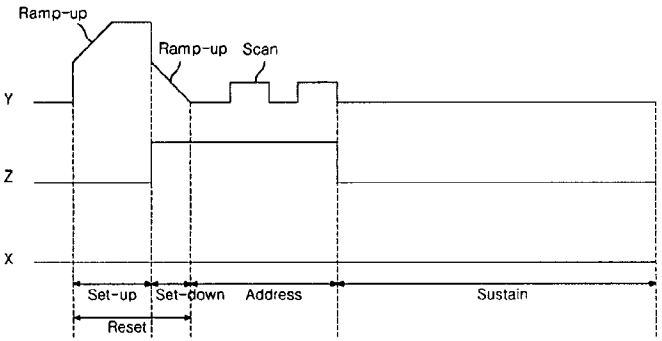
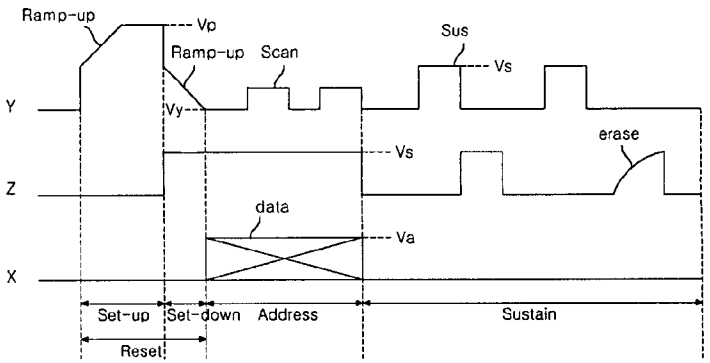
Fig. 6
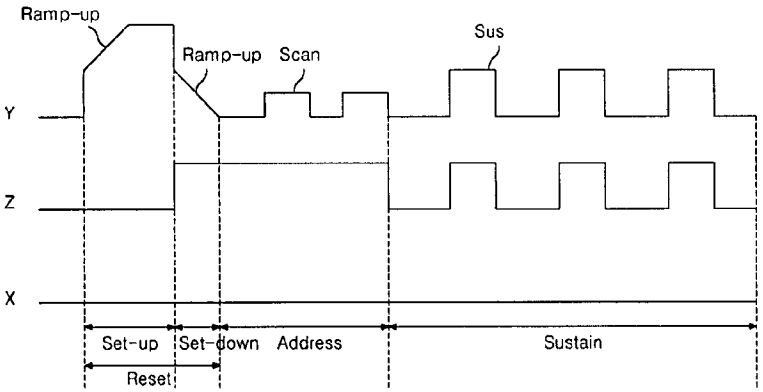

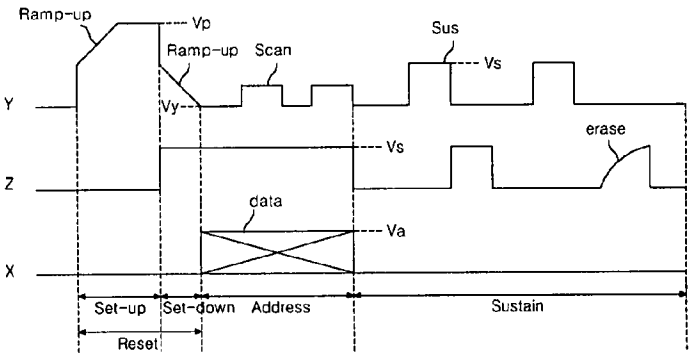
Fig. 7
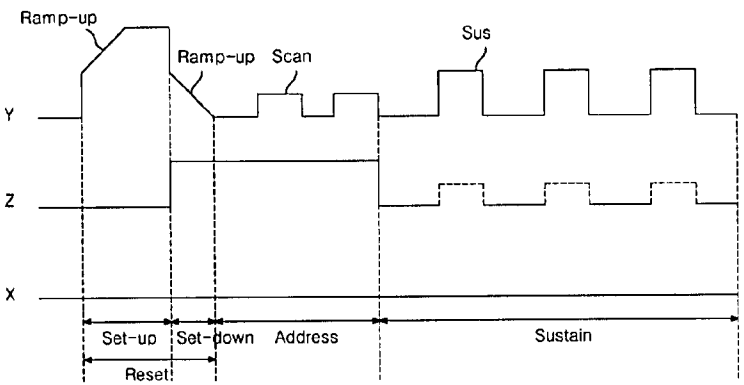
Fig. 8
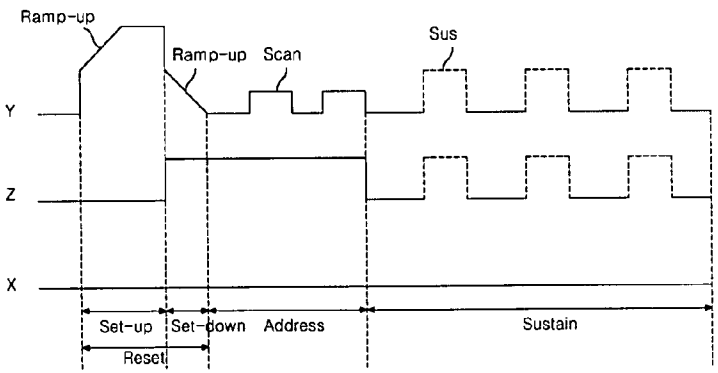

METHOD OF DRIVING PLASMA DISPLAY PANEL

This Nonprovisional application claims priority under 35 U.S.C. §119(a) on Patent Application No. 10-2003-0102174 filed in Korea on Dec. 31, 2003, the entire contents of which are hereby incorporated by reference.

BACKGROUND OF THE INVENTION

1. Field of the Invention

The present invention relates to a plasma display panel, and more particularly to a method of driving a plasma display panel, which can improve display quality.

2. Description of the Background Art

In the recent information society, the importance of a display device as a visual information transmission medium has been stressed than ever. A cathode-ray tube or a Braun tube which is being widely used is heavy and bulky. Hence, various types of flat panel display devices which are capable of overcoming the disadvantages of the cathode-ray tube are being developed.

These flat panel display devices include a plasma display panel (PDP), a field emission display, an electro-luminescence, etc.

The PDP out of these devices displays images and moving pictures, including characters or graphics, by irradiating phosphors by ultraviolet rays of 147 nm generated during a discharge of a mixed gas of He+Xe, Ne+Xe or He+Xe+Ne. The PDP is not only easy to make its thickness thin and its size large but also feasible to greatly improve picture quality thanks to the recent development of technology.

Especially, a tri-electrode AC (Alternative Current) surface-discharge PDP lowers a voltage necessary for a discharge by accumulating barrier charges using a dielectric layer, and has the advantages of a low-voltage driving operation and long life.

FIG. 1 is a perspective view illustrating a discharge cell of a general tri-electrode AC surface-discharge PDP.

Referring to FIG. 1, a discharge cell of the PDP includes a scan electrode Y and a sustain electrode Z formed both on an upper substrate 10, and an address electrode X formed on a lower substrate 18. The scan and sustain electrodes Y and Z include transparent electrodes 12Y and 12Z, respectively, and includes metal bus electrodes 13Y and 13Z, respectively, which are narrower in line width than the transparent electrodes 12Y and 12Z and formed at the edges of the transparent electrodes 12Y and 12Z.

The transparent electrodes 12Y and 12Z formed on the upper substrate 10 are made of Indium-Tin-Oxide (ITO). The metal bus electrodes 13Y and 13Z formed on the transparent electrodes 12Y and 12Z are made of metal, such as chrome (Cr), serving to reduce a drop in a voltage caused by the transparent electrodes 12Y and 12Z having high resistance. An upper dielectric layer 14 and a protective layer 16 are formed on the upper substrate 10 on which the scan and sustain electrodes are formed in parallel. Barrier charges generated during a plasma discharge are formed on the upper dielectric layer 14. The protective layer 16 protects the upper dielectric layer 14 from damaging by a sputtering generated during the plasma discharge and also increases the efficiency of secondary electron emission. A magnesium oxide (MgO) is usually used as the protective layer 16.

A lower dielectric layer 22 and a barrier rib 24 are formed on the lower substrate 18 on which the address electrode X is formed. A phosphor layer 26 is coated over the surfaces of the lower dielectric layer 22 and the barrier rib 24. The address electrode X is perpendicular to the scan and sustain electrodes Y and Z. The barrier rib 24 is formed in parallel to the address electrode X and prevents ultraviolet rays and visual rays generated by a discharge from leaking to an adjacent cell. The phosphor layer 26 is excited by ultraviolet rays generated during a plasma discharge and generates any one visual ray among red, green and blue. An inert mixed gas is injected into a discharge space provided between the upper and lower substrates 10 and 18 and the barrier rib 24.

In order to achieve a gray scale of an image, the PDP is driven on a time-division basis by dividing one frame into subfields each having the different number of irradiations. Each subfield has a reset period for resetting the entire screen, an address period for selecting a scan line and selecting a cell in the selected scan line, and a sustain period for achieving a gray scale according to the number of discharges.

The reset period is further divided into a set-up period for supplying a ramp-up waveform and a set-down period for supplying a ramp-down waveform. For example, if it is desired to display an image by 256 gradations, one frame period corresponding to 1/60 seconds (16.67 ms) is divided into 8 subfields SF1 to SF9, as shown in FIG. 2. Each of the 8 subframes SF1 to SF8 is further divided into the reset period, the address period and the sustain period as described above. The reset and address periods in each subfield are identical with respect to the respective subfields, while the sustain period increases at the rate of 2n (where n is 0, 1, 2, 3, 4, 5, 6 and 7).

FIG. 3 is a waveform diagram illustrating a driving method of the PDP.

Referring to FIG. 3, the PDP is separately driven according to a reset period for resetting the entire screen, an address period for selecting a cell, and a sustain period for sustaining a discharge of the selected cell.

During the reset period, a ramp-up waveform is simultaneously applied to all the scan electrodes Y during a set-up period. In this case, the scan electrodes Y are raised up to a voltage Vp for discharging cells. By this ramp-up waveform, a weak discharge occurs within the cells of the entire screen and wall charges are created within the cells. During a set-down period after the ramp-up waveform is supplied, a ramp-down waveform falling from a positive-polarity voltage lower than the peak voltage of the ramp-up waveform is simultaneously applied to all the scan electrodes Y. The ramp-down waveform creates a weak erase discharge within the cells, erasing unnecessary charges out of the wall charges and space charges generated by the set-up discharge and uniformly sustaining the wall charges necessary for an address discharge within the cells of the entire screen.

During the address period, a negative-polarity scan pulse Scan is sequentially applied to the scan electrodes Y and at the same time a positive-polarity data pulse is applied to the address electrodes. A difference between a voltage Vy of the scan pulse and a voltage Va of the data pulse is added to a wall voltage generated during the reset period to create the address discharge within the cells. The wall charges are generated within the selected cells by the address discharge.

Meanwhile, during the set-down period and the address period, a positive-polarity direct current (DC) voltage of a sustain voltage level Vs is supplied to the sustain electrodes Z.

During the sustain period, a sustain pulse Sus of the sustain voltage level Vs is alternatively applied to the scan electrodes Y and the sustain electrodes Z. Then the wall voltage within the cell is added to the sustain pulse Sus by the address discharge, and a sustain discharge is created between the scan and sustain electrodes Y and Z as a form of a surface discharge whenever each sustain pulse Sus is applied. Finally, after the sustain discharge is completed, an erase ramp waveform having a narrow pulse width is supplied to the sustain electrodes Z, erasing the wall charges within the cell.

In the above-described PDP, a preliminary waveform is supplied during a preliminary period as shown in FIG. 4 in order to ensure time to raise a plurality of voltage sources Vp, Vs, Vy and Va to desired voltages when a power source is turned on.

In this case, the data pulse is not supplied during the address period so as not to create a discharge during the preliminary period. During the reset and sustain periods, the same waveforms as FIG. 3 are applied and thus a detailed description thereof will not be given.

During the preliminary period, however, an undesired sustain discharge occurs, and an afterimage is displayed on the panel. In more detail, the power source of the PDP is randomly turned off by a user at any time, the wall charges remain within the discharge cells. Especially, such wall charges remain largely within the discharge cells displaying bright luminescence before the power source of the PDP is turned off and the undesired sustain discharge occurs during the sustain period of the preliminary period by these remaining charges. Consequently, the afterimage is displayed in a part of the discharge cells which have displayed a bright screen when the power source of the PDP is turned off.

SUMMARY OF THE INVENTION

Accordingly, an object of the present invention is to solve at least the problems and disadvantages of the background art.

According to an aspect of the present invention, there is provided a method for driving a PDP separately during a data driving period for supplying a driving waveform and a preliminary period for raising voltages for supplying the driving waveform up to a desired voltage, in order to display an image in each discharge cell, wherein a waveform supplied to electrodes during a sustain period of the data driving period is different from a waveform supplied to the electrodes during a sustain period of the preliminary period.

According to the present invention, brightness, efficiency and the contrast ratio are improved and high-speed driving is accomplished.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIG. 5 illustrates a preliminary discharge waveform of the PDP according to a first embodiment of the present invention;

FIG. 6 illustrates a preliminary discharge waveform of the PDP according to a second embodiment of the present invention;

FIG. 7 illustrates a preliminary discharge waveform of the PDP according to a third embodiment of the present invention;

FIG. 8 illustrates a preliminary discharge waveform of the PDP according to a fourth embodiment of the present invention.

DETAILED DESCRIPTION OF PREFERRED EMBODIMENTS

Figure 1:
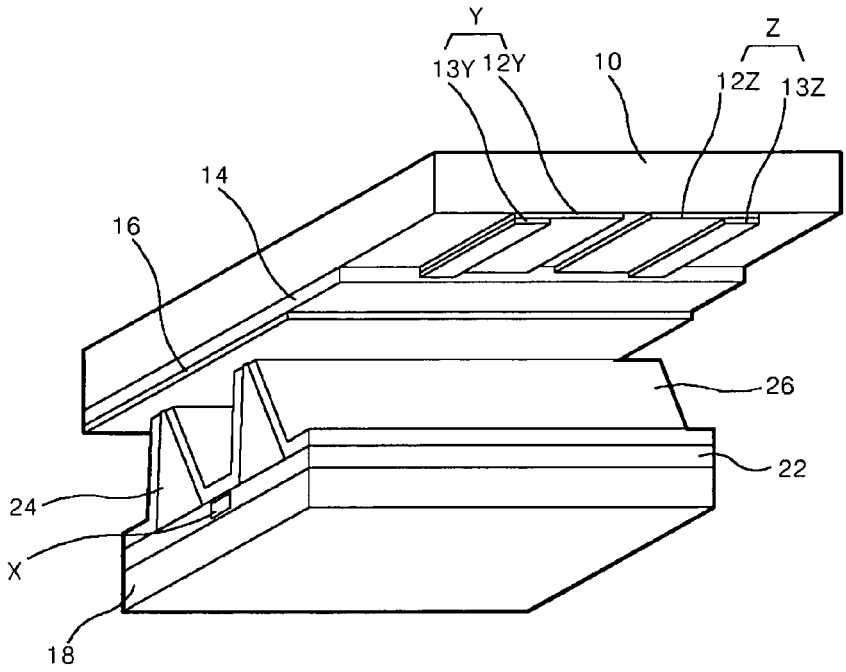
Fig. 1 Prior Art
FIG.1 is a perspective view illustrating a discharge cell of a general tri-electrode AC surface-discharge PDP.
Figure 2:
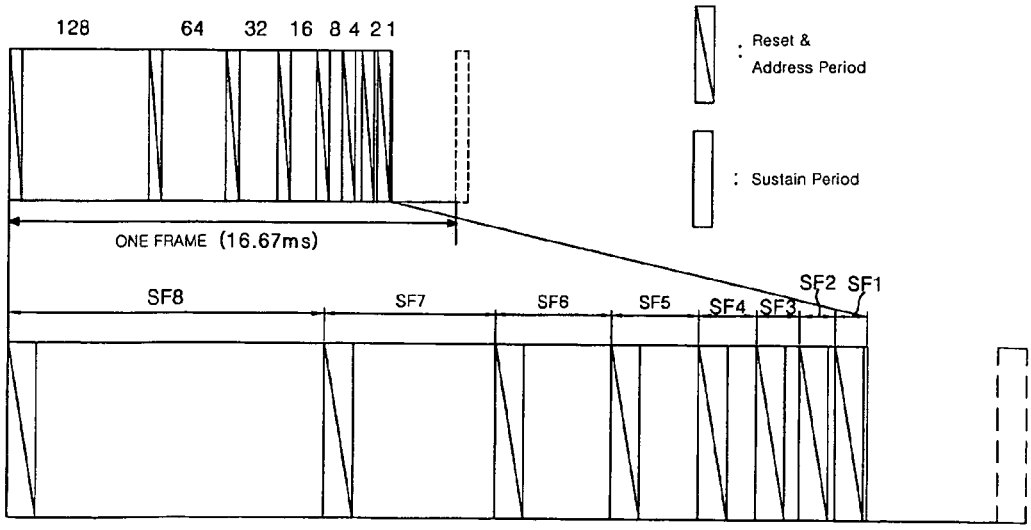
Fig. 2 Prior Art
FIG. 2 is a diagram illustrating one frame of the PDP.

Reference will now be made in detail to the present preferred embodiments of the invention, examples of which are illustrated in the accompanying drawings.

In order to display an image in each discharge cell, in a method for driving a PDP according to the present invention, the PDP is driven separately during a data driving period for supplying a driving waveform and during a preliminary period for raising voltages for supplying the driving waveform up to a desired voltage, in which case a waveform supplied to electrodes during a sustain period of the data driving period is different from a waveform supplied to the electrodes during a sustain period of the preliminary period.

In the method, a ground voltage is supplied to a scan electrode and a sustain electrode contained in the discharge cell during a sustain period of a subfield contained in the preliminary period.

The method includes the steps of supplying a first sustain pulse to a scan electrode contained in the discharge cell during a sustain period of a subfield contained in the preliminary period, and supplying a second sustain pulse synchronized with the first sustain pulse to a sustain electrode contained in the discharge cell.

In the method, either the scan electrode or the sustain electrode contained in the discharge cell is floated during the sustain period of the subfield contained in the preliminary period.

In the method, a sustain pulse is supplied to the other electrode which is not floated.

In the method, a scan electrode and a sustain electrode contained in the discharge cell are floated during a sustain period of a subfield contained in the preliminary period.

In the method, a ground voltage is supplied to electrodes contained in the discharge cell during a sustain period of a subfield contained in the preliminary period.

In the method, the ground voltage is applied to the electrodes contained in the discharge cell for 1 to 3 seconds, preferably 2 seconds, during the sustain period of the subfield contained in the preliminary period.

Preferred embodiments of the present invention will be described in more detail with reference to FIGS. 5 to 9.

FIG. 5 illustrates a preliminary discharge waveform of the PDP according to a first embodiment of the present invention.

Referring to FIG. 5, the preliminary discharge waveform is separately driven according to a reset period for resetting discharge cells, an address period for selecting the discharge cells, and a sustain period for sustaining a discharge of the cells. The preliminary waveform is supplied prior to the data driving waveform shown in FIG. 3.

During the reset period, a ramp-up waveform is simultaneously applied to all the scan electrodes Y during a set-up period. By this ramp-up waveform, a weak discharge occurs within the cells of the entire screen, creating wall charges within the cells. A reset discharge does not occur within the discharge cells because the voltage of the ramp-up waveform is not raised to a desired voltage Vp. During a set-down period after the ramp-up waveform is supplied, a ramp-down waveform falling from a positive-polarity voltage lower than the peak voltage of the ramp-up waveform is simultaneously supplied to the scan electrodes Y.

During the address period, a negative-polarity scan pulse Scan is sequentially applied to the scan electrodes Y and a ground voltage is applied to the address electrodes X. Since there is no a voltage difference enough to create an address discharge between the scan electrodes Y and the address electrodes X, that is, since a data pulse is not supplied, the address discharge does not occur.

Meanwhile, a positive-polarity DC voltage of a sustain voltage level Vs is supplied to the sustain electrodes Z during the set-down and address periods.

During the sustain period, the ground voltage is applied to the scan electrodes Y and the sustain electrodes Z. Thus if the ground voltage is applied to the scan electrodes Y and the sustain electrodes Z, a sustain discharge does not occur during the sustain period of a subfield contained in a preliminary period. That is, since a discharge does not occur between the scan electrodes Y and the sustain electrodes Z, it is possible to prevent an afterimage from being displayed during the preliminary period.

Figure 3:
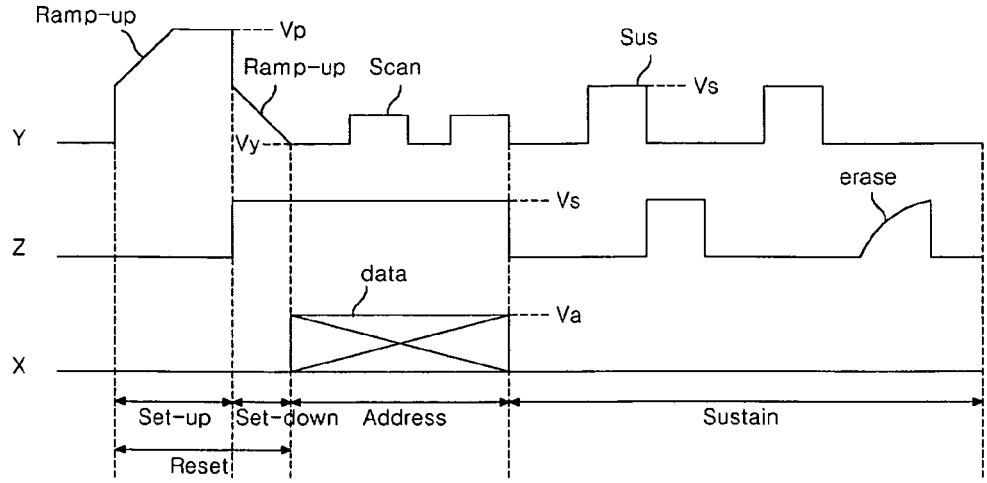
Fig. 3 Prior Art
FIG. 3 is a waveform diagram illustrating a driving method of the PDP.
Figure 4:
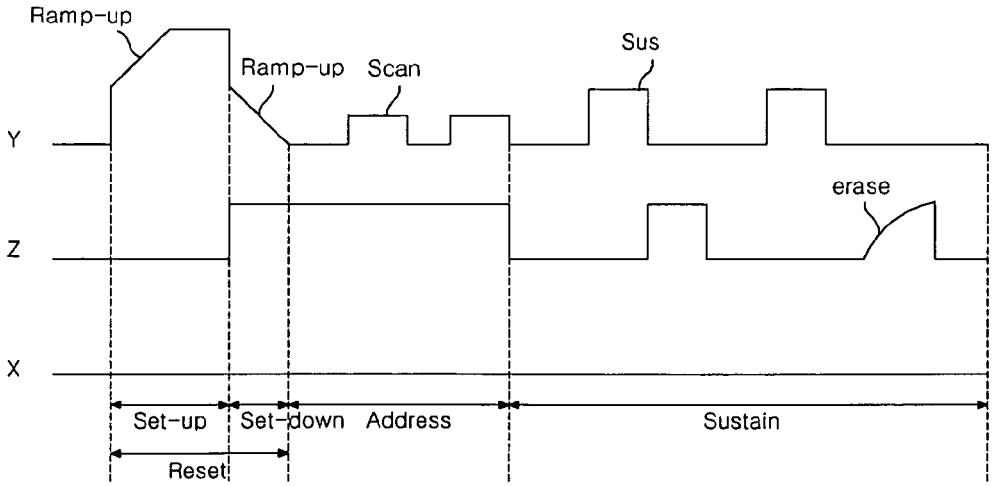
Fig. 4 Prior Art
FIG. 4 illustrates a preliminary discharge waveform of the PDP according to a prior art.

Actually, a plurality of subfields shown in FIG. 5 is applied during the preliminary period so as to raise the voltages of the electrodes Y, Z and X up to a desired voltage, for example, Vp, Vy, Vs or Va. Thereafter, the data driving waveform shown in FIG. 3 is applied to the scan, sustain and address electrodes to achieve the image of the PDP. As illustrated in FIGS. 3 and 5, the preliminary discharge waveform and the data driving waveform differ from each other.

FIG. 6 illustrates a preliminary discharge waveform of the PDP according to a second embodiment of the present invention.

Referring to FIG. 6, the preliminary discharge waveform is separately driven according to a reset period for resetting discharge cells, an address period for selecting the discharge cells, and a sustain period for sustaining a discharge of the cells.

The reset period and the address period have the same waveform as the first embodiment of the present invention and thus a detailed description thereof is omitted.

During the sustain period, the sustain pulse Sus which is synchronized, that is the sustain pulse Sus of the same magnitude and the same time period is applied to the scan electrodes Y and the sustain electrodes Z. Thus if the synchronized sustain pulse Sus is applied to the scan electrodes Y and the sustain electrodes Z, since there is no voltage difference between the scan electrodes Y and the sustain electrodes Z, a sustain discharge does not occur between the scan electrodes Y and the sustain electrodes Z. Therefore, it is possible to prevent an afterimage from being displayed during the preliminary period.

Actually, a plurality of subfields shown in FIG. 6 is applied during the preliminary period so as to raise the voltages of the electrodes Y, Z and X up to a desired voltage, for example, Vp, Vy, Vs or Va. Thereafter, the data driving waveform shown in FIG. 3 is applied to the scan, sustain and address electrodes to achieve the image of the PDP. As illustrated in FIGS. 3 and 6, the preliminary discharge waveform and the data driving waveform differ from each other.

FIG. 7 illustrates a preliminary discharge waveform of the PDP according to a third embodiment of the present invention.

Referring to FIG. 7, the preliminary discharge waveform is separately driven according to a reset period for resetting discharge cells, an address period for selecting the discharge cells, and a sustain period for sustaining a discharge of the cells.

The reset period and the address period have the same waveform as the first embodiment of the present invention and thus a detailed description thereof is omitted.

During the sustain period, the sustain pulse Sus is applied to at least one of the scan electrodes Y and the sustain electrodes Z. Half the sustain pulse Sus is induced to the other electrodes Y or Z. In this case, half of the sustain pulse Sus is induced as a floating state. Thus, a sustain discharge does not occur between the scan electrodes Y and the sustain electrodes Z. Therefore, it is possible to prevent an afterimage from being displayed during the preliminary period.

Actually, a plurality of subfields shown in FIG. 7 is applied during the preliminary period so as to raise the voltages of the electrodes Y, Z and X up to a desired voltage, for example, Vp, Vy, Vs or Va. Thereafter, the data driving waveform shown in FIG. 3 is applied to the scan, sustain and address electrodes to achieve the image of the PDP. As illustrated in FIGS. 3 and 7, the preliminary discharge waveform and the data driving waveform differ from each other.

FIG. 8 illustrates a preliminary discharge waveform of the PDP according to a fourth embodiment of the present invention.

Referring to FIG. 8, the preliminary discharge waveform is separately driven according to a reset period for resetting discharge cells, an address period for selecting the discharge cells, and a sustain period for sustaining a discharge of the cells.

The reset period and the address period have the same waveform as the first embodiment of the present invention and thus a detailed description thereof is omitted.

During the sustain period, the sustain pulse Sus of a floated state is applied to the scan electrodes Y and the sustain electrodes Z. Thus, a sustain discharge does not occur between the scan electrodes Y and the sustain electrodes Z. Therefore, it is possible to prevent an afterimage from being displayed during the preliminary period.

Actually, a plurality of subfields shown in FIG. 8 is applied during the preliminary period so as to raise the voltages of the electrodes Y, Z and X up to a desired voltage, for example, Vp, Vy, Vs or Va. Thereafter, the data driving waveform shown in FIG. 3 is applied to the scan, sustain and address electrodes to achieve the image of the PDP. As illustrated in FIGS. 3 and 8, the preliminary discharge waveform and the data driving waveform differ from each other.

Figure 9:
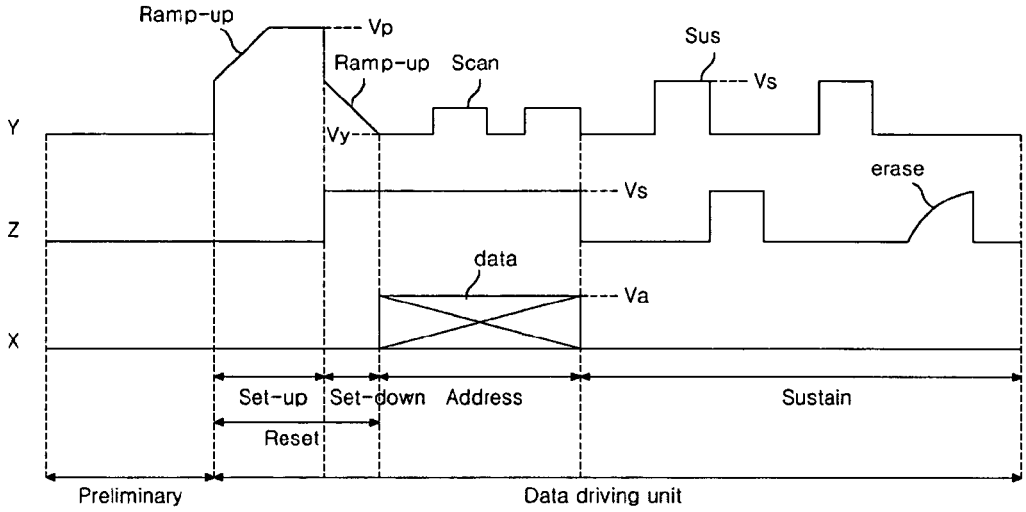
FIG. 9 illustrates a preliminary discharge waveform of the PDP according to a fifth embodiment of the present invention.
Figure 10:
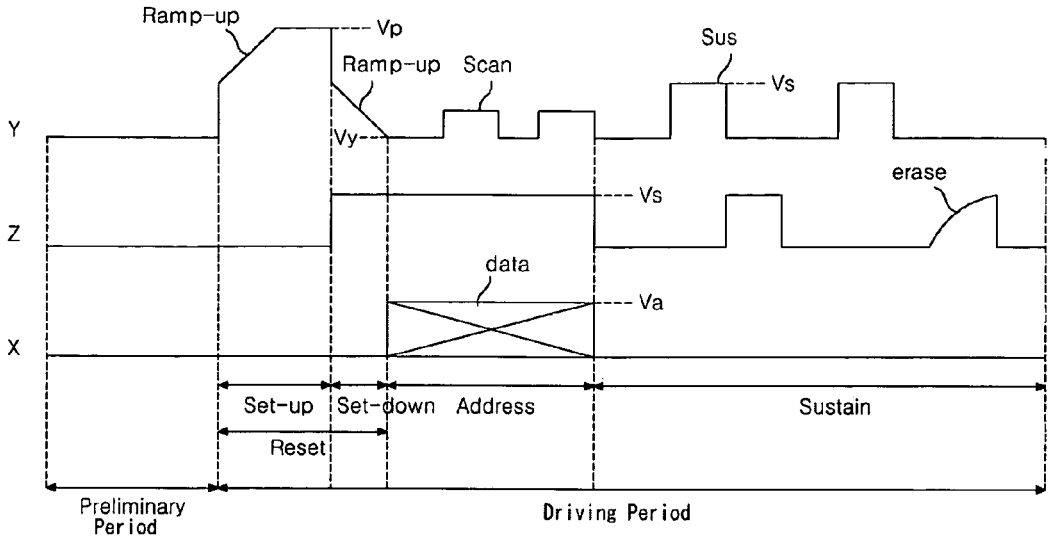
FIG. 10 illustrates both a preliminary discharge waveform and a waveform diagram illustrating a driving method in a single figure.

FIG. 9 illustrates a preliminary discharge waveform of the PDP according to a fifth embodiment of the present invention.

Referring to FIG. 9, a ground voltage is applied to the electrodes Y, Z and X during the preliminary period prior to the data driving period for supplying a driving waveform in order to display an image in each discharge cell. The preliminary period is set to 1 to 3 seconds, preferably, 2 seconds so as to raise the voltages of the driving waveform up to a desired voltage, for example, Vp, Va, -Vy or Vs. In other words, as shown in the preliminary discharge waveform of the PDP of FIG. 5, the ground voltage is supplied to the scan electrodes Y, the sustain electrodes Z and the address electrodes X for 1 to 3 seconds, preferably 2 seconds. In this case, during the preliminary discharge period, charges existing within the discharge cells during a previous driving state of the PDP that is, during a turn-off operation of the PDP are eliminated. Therefore, an afterimage caused by the previous driving state doesn't occur and the display quality of the PDP can be improved. Thereafter, during the data driving period, desired voltages are supplied to the scan electrodes Y, the sustain electrodes Z and the address electrodes X, and the PDP displays an image stably.

A method for driving a PDP according to the present invention does not create a sustain discharge during a sustain period and prevents an afterimage caused by a previous state when the PDP is turned on from being displayed, improving display quality. Moreover, the method eliminates charges within a discharge cell by supplying a ground voltage to electrodes for 1 to 3 seconds, preferably 2 seconds, before a data driving waveform is supplied, preventing an afterimage from being displayed and improving display quality.

According to the present invention, brightness, efficiency and the contrast ratio are improved and high-speed driving is accomplished.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A method for driving a plasma display panel, the method comprising:

supplying a first waveform to the plasma display panel during a preliminary period, the preliminary period comprising at least one sub-field, each sub-field including a first reset period, a first address period, and a first sustain period, wherein a data pulse is not supplied during the first address period of the preliminary period; and supplying a second waveform to the plasma display panel during a data driving period, the data driving period comprising a plurality of sub-fields including a second reset period, a second address period and a second sustain period, wherein the data driving period begins after the first waveform is supplied during the preliminary period and the second waveform supplied to electrodes of the plasma display panel during the second sustain period of the data driving period is different from the first waveform supplied to the electrodes during the first sustain period of the preliminary period.

2. The method as claimed in claim 1, wherein a ground voltage is supplied to a scan electrode and a sustain electrode the sustain period of the at least one subfield contained in the preliminary period.

3. The method as claimed in claim 1, including the steps of:

supplying a first sustain pulse to a scan electrode during the at least one sustain period of a subfield contained in the preliminary period; and supplying a second sustain pulse synchronized with the first sustain pulse to a sustain electrode during the at least one sustain period in the preliminary period.

4. The method as claimed in claim 3, wherein either the scan electrode or the sustain electrode is floated during the sustain period of the at least one subfield contained in the preliminary period.

5. The method as claimed in claim 4, wherein a sustain pulse is supplied to the other electrode which is not floated.

6. The method as claimed in claim 1, wherein a scan electrode and a sustain electrode are floated during a sustain period of the at least one subfield contained in the preliminary period.

7. The method as claimed in claim 1, wherein a ground voltage is supplied to electrodes of the plasma display period during a sustain period of the at least one subfield contained in the preliminary period.

8. A method of driving a plasma display panel, the method comprising:

supplying a first waveform to the plasma display during a preliminary period, wherein a data pulse is not supplied during the preliminary period;

supplying a second waveform to the plasma display panel during a data driving period, the data driving period comprising a plurality of sub-fields including a first reset period, a first address period and a first sustain period, wherein the data driving period beings after the first waveform is supplied during the preliminary period;

the second waveform supplied to electrodes of the plasma display panel during the data driving period is different from the first waveform supplied to the electrodes during the preliminary period, wherein the duration of the preliminary period is 1 to 3 seconds and a ground voltage is applied to the electrodes during the preliminary period.

9. The method as claimed in claim 8, wherein the ground voltage is applied to the electrodes for 1 to 3 seconds.

10. The method as claimed in claim 9, wherein the ground voltage is applied to the electrodes for 2 seconds.

11. The method as claimed in claim 8, wherein the preliminary period includes a second reset period, a second address period and a second sustain period; and the ground voltage is applied to the electrodes during the sustain period of the preliminary period.

12. The method as claimed in claim 11, wherein the duration of the sustain period is at least 2 seconds and the ground voltage is applied to the electrodes for 2 seconds.

13. A method for driving a plasma display panel, comprising:

supplying power to the plasma display panel;

supplying a first waveform to the plasma display panel during a preliminary period, wherein a data pulse is not supplied during the preliminary period;

supplying a second waveform to the plasma display panel during a data driving period after the first waveform is supplied during the preliminary period, wherein the first waveform is different from the second waveform; and discontinuing power to the plasma display panel.

14. The method as claimed in claim 13, wherein preliminary period only occurs after supplying power to the plasma display panel and before the data driving period.

* * * * *